US005380130A

United States Patent [19]

Kessler et al.

[11] Patent Number: 5,380,130

[45] Date of Patent: Jan. 10, 1995

[54] PREINSTALLED ADJUSTABLE CONDUCTOR GUIDE

[75] Inventors: Kerry J. Kessler, Kenner; Roger G. Smith, Lafayette, both of La.

[73] Assignees: Kerr-McGee Corp., Oklahoma City, Okla.; McDermott International, Inc., New Orleans, La.

[21] Appl. No.: 123,663

[22] Filed: Sep. 20, 1993

[51] Int. Cl.[6] ..... E02B 17/00

[52] U.S. Cl. ..... 405/195.1; 166/350; 166/367; 166/241.1; 405/224; 405/227

[58] Field of Search ..... 405/195.1, 169, 170, 405/171, 227, 226, 225; 166/350, 359, 367, 241.6, 241.1; 138/112, 113, 114; 285/133.1, 138, 177; 248/523, 524; 114/264, 265

[56] References Cited

U.S. PATENT DOCUMENTS

| | | | |
|---|---|---|---|
| 2,559,933 | 7/1951 | Briney | 248/523 X |
| 2,909,393 | 10/1959 | Price et al. | 166/241.1 X |
| 2,944,403 | 7/1960 | Smith | 405/199 |
| 2,961,837 | 11/1960 | Suderow | 405/199 |
| 3,373,570 | 3/1968 | Hindman | 405/169 |
| 3,670,507 | 6/1972 | Mott et al. | 405/227 |
| 4,479,401 | 10/1984 | Korkut | 405/198 X |
| 4,497,592 | 2/1985 | Lawson | 405/227 X |
| 5,035,542 | 7/1991 | Bassett | 405/199 X |

FOREIGN PATENT DOCUMENTS

| | | | |
|---|---|---|---|
| 3142207 | 10/1984 | Germany | 248/523 |

*Primary Examiner*—Dennis L. Taylor

*Attorney, Agent, or Firm*—Robert J. Edwards; D. Neil LaHaye

[57] ABSTRACT

A preinstalled, adjustable conductor guide for offshore platforms. A conductor guide is provided with apertures spaced around its circumference. A rectangular tube is rigidly attached to the conductor guide at each aperture such that the tube extends upwardly from the conductor guide at an angle. The tube is provided with a plurality of offset slotted holes along its length on opposing sides. A slide having a plurality of offset holes along its length is received in the tube and movable between a first retracted position and a second inserted position. A bolt, received through the holes in the tube and slide, and nut are used to retain the slide in either the first or second position.

6 Claims, 2 Drawing Sheets

PREINSTALLED ADJUSTABLE CONDUCTOR GUIDE

BACKGROUND OF THE INVENTION

1. Field of the Invention

The present invention is generally related to offshore platforms for drilling wells and particularly to underwater conductor guides used with the offshore platforms and jackets.

2. General Background

The drilling and completing of wells on offshore platforms is accomplished through large diameter steel pipes, called conductors, which are driven into the soil through guides connected to the offshore platform's jacket and deck. Conductors can also be pre-installed by exploratory drilling vessels and completed to a height of 10 to 20 feet above the seabed prior to jacket installation. The jacket is then lowered over these pre-installed conductors and then the conductors are extended to the surface after jacket installation is complete. The jacket is a tubular steel framework that serves as a pile template and conductor support and extends from the seabed to a few feet above the waterline. The deck is the platform's steel superstructure above the warterline which is connected to the piling, or jacket, and supports the drilling and producing facilities. The piling consists of steel tubes which secure the platform to the seabed and penetrate the soil up to 300–600 feet. Platform components (jacket, deck, piling, etc.) are built on land at fabrication yards as completely as possible in order to minimize the much more expensive offshore (site) construction.

Conductor guides are framed at various elevations within the jacket and deck to provide support for conductors such that the effect of the environment (waves, wind, current, etc.) can be safely withstood by the conductors and to maintain conductor alignment. Conductor guides are tubular shaped and open at each end to receive the conductor. The top of conductor guides, and in certain cases the bottom also, is flared outwardly in a bell or cone shape to aid in aligning and receiving the conductor and the protective bullet (cover) on a conductor on an existing well or jacket template. There are several types of conductor guide systems utilized in the offshore industry.

The more common system consists of guides rigidly connected to the jacket and deck framework. Conductors are placed through these guides and are designed to withstand forces resulting from the environment. The conductor guides and structural framework provide support for the conductors at various levels throughout the jacket and deck. Whenever possible, these conductor guides are fabricated and welded to the jacket and deck at the fabrication yard (on land) to minimize construction costs. However, some offshore construction of guides is necessary whenever jackets are set over existing wells.

Generally, three types of conductor guide assemblies are provided for this system. The first type are those within the horizontal framework levels of the jacket and typically consist of vertical guides made out of steel tubes welded to the horizontal jacket tubular members. The other types are located in the lower and upper levels of the deck. The lower deck level guides are similar to the jacket's, except they are connected to deck floor beams. These guides are located in line with the jacket guides. The upper deck level assembly consists of a grid of beams bolted to the permanent upper deck beams supporting removable hatches which line up with the conductor guides in the lower deck. Access is provided to the lower deck level, which is typically the conductor termination level, by removing the hatches.

The advantages and disadvantages of this system follow:

a. Conductor guides and framing are normally built within the jacket and deck during land fabrication, thereby minimizing construction costs.
b. Occasionally jackets are set over existing wells. For these cases, offshore construction of guide assemblies is normally required.
c. Since the conductors are exposed to environmental loads, it is usually not feasible to utilize this system in areas of extreme environmental effects, such as mudslides or ice movement.

If existing wells are present as mentioned in (b) above then it is necessary to enlarge the conductor guides of an offshore platform to accommodate removal of a protective "bullet" or to allow for misalignment of the wells. Typically conductor guides are sized to provide an annulus clearance of ½" between the inside of the guide and the outside of the conductor.

A larger annulus clearance creates a problem once the well is connected from the seabed to the surface. Without the usual small annulus the conductors can move with wave motion within the guide, causing potentially dangerous cracks in the well casing. To remedy this, bolted wedge plates are installed by divers at the underwater guides only, typically four to six for each conductor guide, which stop well casing movement by reducing the annulus.

The bolted wedges can not be pre-installed on the guide since they attach to the inclined surface at the top of the guides and the conductor casing could damage them as it is lowered through the guides. Additionally, divers have to install each wedge by removing them from a lowered basket, swimming back to the guide and attaching four bolts through the wedges and the conductor guide. This can be a very time consuming and costly phase of the project.

This leaves a need for conductor guides that are more readily adjustable to bring the clearance annulus to an acceptable range and that minimize the requirements for equipment, time, and diver effort.

SUMMARY OF THE INVENTION

The present invention addresses the above needs in a straightforward manner. What is provided is a preinstalled adjustable conductor guide for offshore platforms. The conductor guide is attached to the offshore platform and provided with a plurality of apertures spaced around its circumference. A rectangular tube open at each end is attached to the conductor guide at each aperture such that the rectangular tube extends upwardly away from the conductor guide at an angle. The rectangular tube is provided with a set of offset slotted holes along its length and aligned on opposing sides of the tube. A rectangular slide is received in each rectangular tube and is provided with a handle on one end and a nonabrasive surface on the opposite end. A number of offset holes are provided through the slide along its length that match the spacing of the offset holes in the rectangular tube. Before the offshore platform is installed, a slide is positioned in each rectangular tube such that the nonabrasive surface does not extend into the interior of the conductor guide. A bolt is inserted through the holes in the tube and slide and a nut is threaded on the bolt to hold the slide in the desired position. After installation of the platform and conductors through the conductor guides, it is then only necessary for a diver to remove the nut and bolt, let the slide move into contact with the conductor, and then reinstall the bolt and nut to secure the slide in position. This procedure is repeated for all the rectangular tubes and slides provided on the conductor guides and requires only a minimum of tools and time by the diver.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
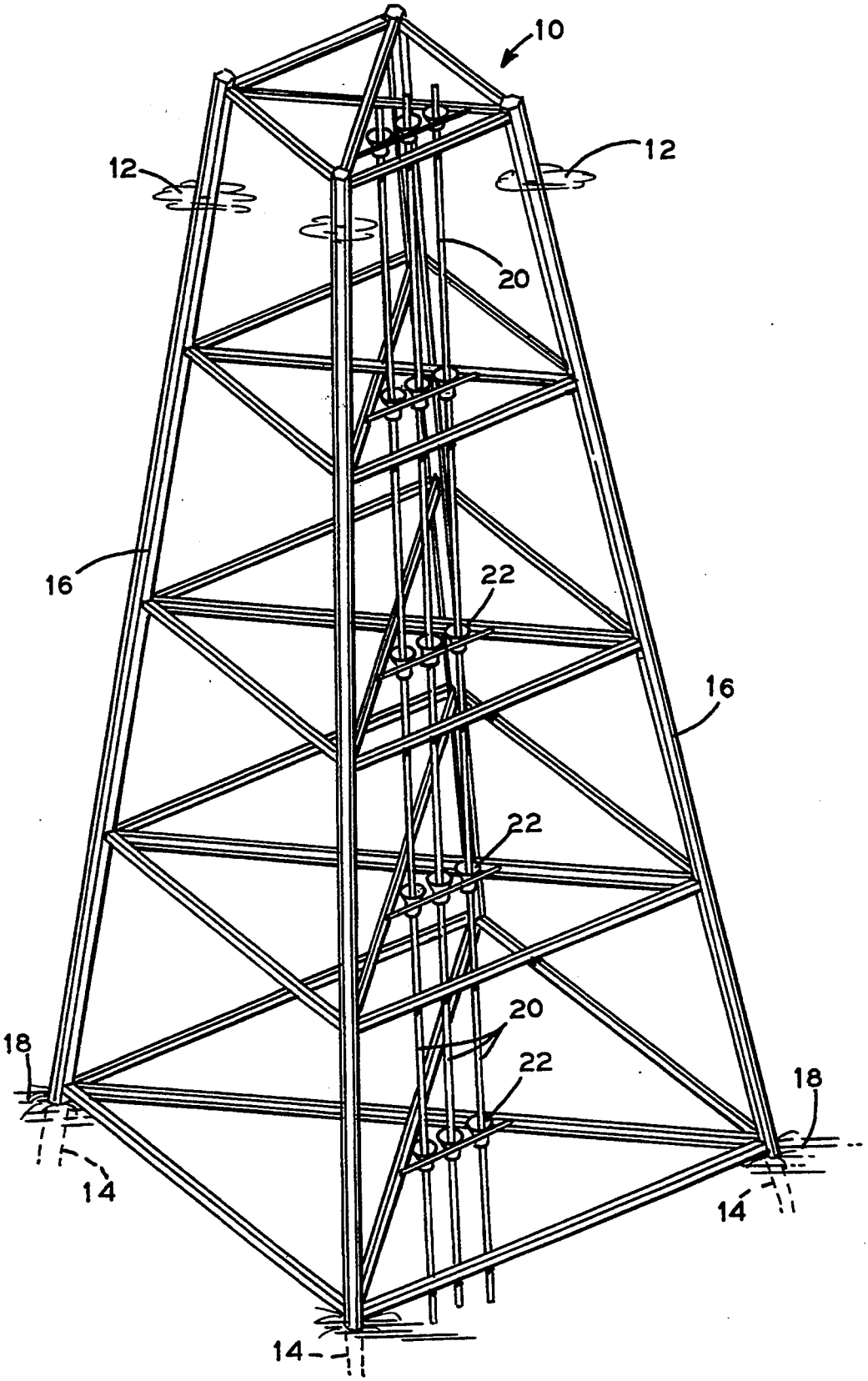
FIG. 1 is a partial view of an offshore platform that illustrates the jacket.

FIG. 1 generally illustrates the jacket 10 of an offshore platform. The jacket extends above the normal water line 12 and is secured in position by pilings 14 that extend through the jacket legs 16 and into the sea bottom 18. The conductor 20 houses the drill bit and drill string during drilling operations. A conductor guide 22 is provided at each level of jacket 10 to provide lateral support to conductor 20. Although only three conductors are shown for ease of illustration, it should be understood that many conductors are often required since a number of wells can be drilled from one offshore platform.

Figure 2:
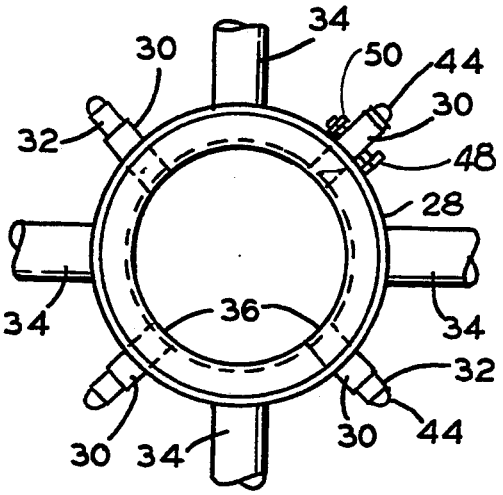
FIG. 2 is a plan view of the invention.
Figure 3:
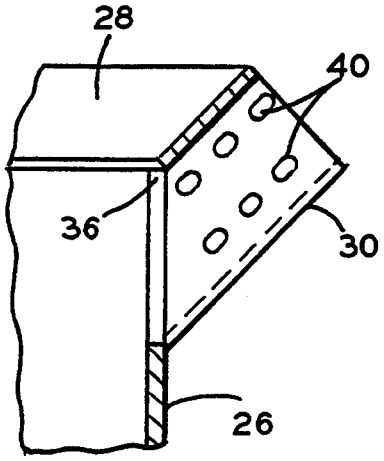
FIG. 3 is a detail view of the rectangular tube of the invention.
Figure 4:
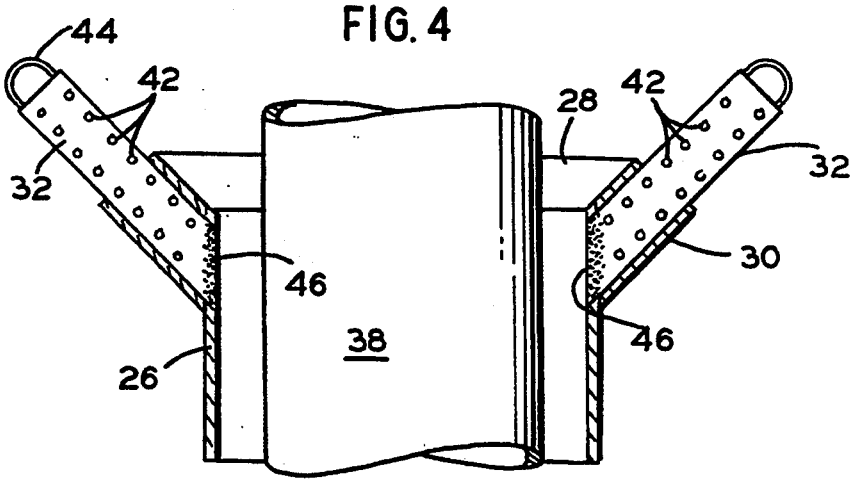
FIG. 4 is a side sectional view of the invention that illustrates the slide in the retracted position.

Referring to FIG. 2–4, it is seen that the invention is generally indicated by the numeral 24. Preinstalled, adjustable conductor guide 24 is generally comprised of tube 26, cone 28, rectangular tube 30, and slide 32. Structural supports 34 from jacket 10 are attached to the exterior of tube 26 to support adjustable conductor guide 24 at its installed level in jacket 10.

Tube 26 is provided with apertures 36 equally spaced around its circumference. Cone 28 extends outwardly from the top edge of tube 26 and serves as alignment and guidance means for receiving a conductor 38. A rectangular tube 30 open at each end is attached to tube 26, and cone 28 if necessary for support, at each aperture 36 such that rectangular tube 30 extends upwardly from tube 26 at an angle. As best seen in FIG. 3, rectangular tube 30 is provided with a number of offset slotted holes 40 along its length. Slotted, offset holes 40 are provided on opposing sides of rectangular tube 30 to allow installation of a bolt therethrough as seen in FIG. 2.

Figure 5:
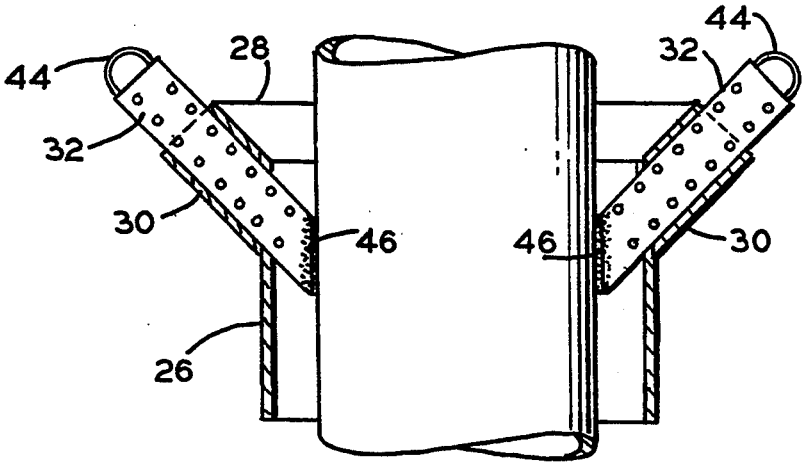
FIG. 5 is a side sectional view of the invention that illustrates the slide inserted against the conductor.

A slide 32, best seen in FIG. 4 and 5, is sized to be received in rectangular tube 30 and movable between a first retracted position and a second inserted position. Slide 32 is provided with a number of offset holes 42 that are spaced to match slotted holes 40 in rectangular tube 30. The lower end of slide 32 is shaped to match the curvature of the exterior of conductor 38. The lower end of slide 32 is also preferably coated with or formed from a nonabrasive surface 46 such as rubber or teflon to prevent damage to conductor 38. A ring or handle 44 may be provided on the upper end of slide 32 to facilitate installation during fabrication and to aid the diver during underwater operations.

During fabrication of the jacket 10 on land, adjustable conductor guides 24 are rigidly attached to the jacket at the appropriate levels and positions. A slide 32 is placed in each rectangular tube 30 such that slide 32 is in a first retracted position as in FIG. 4 where the lower end does not protrude through the aperture 36 into the interior of conductor guide 24. Means for retaining the slide 32 in either the first retracted or second inserted position, seen in FIG. 1, is provided in the form of a bolt 48 that is installed through aligned holes in rectangular tube 30 and slide 32 such that the bolt extends beyond the opposite side of rectangular tube 30. A nut 50 is then threaded onto bolt 48. The installed nut and bolt serve to retain slide 32 in its first retracted position during transport and installation of the jacket 10. After the jacket 10 is installed and secured in position on the sea bottom and conductors are installed through the conductor guides, a diver is sent underwater to make the necessary adjustments to insure that the conductors 38 are properly supported by the conductor guides 24. The only tools needed by the diver are a wrench and hammer. The diver unthreads nut 50 from bolt 48 and removes bolt 48 from rectangular tube 30 and slide 32. This allows slide 32 to move downwardly in rectangular tube 30 to a second inserted position where the lower end of slide 32 is inside tube 26 and in contact with conductor 38 as seen in FIG. 5. The diver then reinserts bolt 48 through the holes in rectangular tube 30 and slide 32 and rethreads nut 50 into the bolt to secure slide 32 in its second inserted position. Offset slotted holes 40 and holes 42 are sized and positioned so that at least one set of slots and holes in rectangular tube 30 and slide 32 will line up to receive the bolt with little or no adjustment being required by the diver. If it is felt to be necessary, the diver can damage the threads on the bolt after the nut is installed to insure that the nut and bolt assembly will not loosen and allow movement of slide 32. The procedure is repeated at all positions on all the conductor guides without the need for the diver to make time consuming trips back and forth to an equipment basket suspended from a work barge as previously done. As seen in FIG. 2, four rectangular tubes 30 and slides 32 are provided on each adjustable conductor guide 24 in the preferred embodiment. Although tube 30 is described as rectangular in the preferred embodiment, it should be understood that any suitable shape may be used, preferably one that prevents rotation of slide 30 during movement from its first to second position to provide the greatest ease in aligning holes 42 with slots 40.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A preinstalled, adjustable conductor guide for offshore platforms, comprising:

a. a conductor guide attached to the offshore platform and sized to receive a conductor, said conductor guide having at least three apertures through the conductor guide wall that are equally spaced apart around the circumference of said conductor guide;

b. a rectangular tube, open at each end, attached to said conductor guide at each aperture such that said tube extends upwardly from said conductor guide at an angle, said rectangular tube being provided with a plurality of offset slotted holes on opposing sides of said rectangular tube;

c. a slide sized to be received in each of said rectangular tubes so as to be movable between a first retracted position and a second inserted position, said slide being provided with a plurality of offset holes along its length that match the spacing of the offset holes in said rectangular tube; and d. means received through the offset holes in said rectangular tubes and said slides for selectively retaining said slides in either their first or second positions.

2. The adjustable conductor guide of claim 1, wherein four of said tubes are provided on said conductor guide.

3. The adjustable conductor guide of claim 1, wherein the lower end of said slide is shaped to match that of the conductor.

4. The adjustable conductor guide of claim 1, wherein the lower end of said tube is provided with a nonabrasive surface.

5. A preinstalled, adjustable conductor guide for offshore platforms, comprising:

a. a conductor guide attached to the offshore platform and sized to receive a conductor, said conductor guide having at least three apertures through the conductor guide wall that are equally spaced apart around the circumference of said conductor guide;

b. a rectangular tube, open at each end, attached to said conductor guide at each aperture such that said tube extends upwardly from said conductor guide at an angle, said rectangular tube being provided with a plurality of offset slotted holes on opposing sides of said rectangular tube;

c. a slide sized to be received in each of said rectangular tubes so as to be movable between a first retracted position and a second inserted position, said slide being provided with a plurality of offset holes along its length that match the spacing of the offset holes in said rectangular tube and having a nonabrasive surface on its lower end shaped to match the conductor; and d. means received through the offset holes in said rectangular tubes and said slides for selectively retaining said slides in either their first or second positions.

6. The adjustable conductor guide of claim 5, wherein four of said tubes are provided on said conductor guide.

* * * * *